United States Patent [19]

DiDomenico

[11] Patent Number: 4,829,788

[45] Date of Patent: May 16, 1989

[54] PIERCED EARRING HAVING COMPOSITE METALLIC/PLASTIC POST

[76] Inventor: Joseph DiDomenico, 575 Mount Pleasant Ave., Providence, R.I. 02908

[21] Appl. No.: 199,857

[22] Filed: May 26, 1988

[51] Int. Cl.[4] ..... A44C 7/00

[52] U.S. Cl. ..... 63/12; 63/DIG. 3

[58] Field of Search ..... 63/12, 13, DIG. 3; 128/330

[56] References Cited

U.S. PATENT DOCUMENTS

| | | | |
|---|---|---|---|
| 4,067,341 | 1/1978 | Ivey | 63/12 X |
| 4,593,540 | 6/1986 | Cuvar et al. | 63/12 |
| 4,682,477 | 7/1987 | Vaillancourt | 63/12 |

FOREIGN PATENT DOCUMENTS

| | | | |
|---|---|---|---|
| 2581520 | 11/1986 | France | 63/12 |
| 2179237 | 3/1987 | United Kingdom | 63/12 |
| 2187930 | 9/1987 | United Kingdom | 63/12 |

*Primary Examiner*—Kenneth J. Dorner
*Assistant Examiner*—Cranmer Laurie K.
*Attorney, Agent, or Firm*—Salter & Michaelson

[57] ABSTRACT

A pierced earring assembly comprising an ornamental portion having a metallic wire post secured thereto and extending inwardly from the inner side thereof, a plastic post having an inner bore extending from one end thereof and terminating intermediate the length of said plastic post, said wire post extending into said bore and being secured therein with the said one end of said plastic post terminating adjacent to but in spaced relation to the inner surface of said ornamental portion.

10 Claims, 1 Drawing Sheet

PIERCED EARRING HAVING COMPOSITE METALLIC/PLASTIC POST

BACKGROUND OF THE INVENTION

This invention relates generally to earrings, and more particularly to pierced earrings of the type conventionally comprising an ornament having a post extending therefrom and passing through a pierced opening in the wearer's lobe, with clutch means provided at the free end of the post to maintain the earring on the wearer's ear.

In recent years pierced earrings have become increasingly popular, because they are less likely to become inadvertently detached from the wearer's lobe and lost than are conventional screw-back or pressure-clip earrings. This, of course, becomes a more important factor with earrings of anything more than minimal monetary value. However, one of the more dramatic shortcomings of pierced earrings is the fact that the wearer's lobe frequently becomes irritated or infected by the repeated penetration of the metallic post through the pierced lobe of the wearer even where the post is constructed of a hypoallergenic material, such as surgical steel or gold.

The prior art has recognized this problem and has attempted to overcome same by providing a nontoxic plastic protector that slides over the metallic earring post or ear wire that extends through the wearer's lobe so that the ear lobe does not make direct contact with the metallic post or wire, but rather contacts only the plastic sleeve. The patent to IVEY U.S. Pat. No. 4,067,341 dated Jan. 10, 1978 illustrates this concept; and while this approach has met with some degree of success, it has the obvious shortcomings of involving a separate member, i.e., the plastic sleeve, which may become lost or misplaced, plus the problem of insuring that the plastic sleeve is properly positioned on the post or wire so as to prevent the wearer's lobe from making direct contact with the latter.

Another approach to this problem is to make the post of a nontoxic plastic and to use a plastic clutch, whereupon there is no metal member so that can be engaged by the wearer's lobe. The patent to CUVAR U.S. Pat. No. 4,593,540 discloses such a pierced earring assembly, it being noted in the CUVAR patent that the plastic post is provided with an enlarged flange or base at one end thereof that is adapted to be secured by cementing or the like to the inner surface of the earring ornament. The problem with this type of arrangement is that although the flange or base can be effectively secured to the inner surface of the ornament where said inner surface is flat, such is not the case where the inner surface of the ornament is of a curved configuration, because it is extremely difficult, if not impossible, to effectively secure a flat base or flange to a curved surface. And while the CUVAR patent recognizes this problem and suggests that the base or flange be shaped or curved so as to conform to the curvature of the inner surface of the ornament, this obviously is not feasible because there is no end to the number of different shapes or curvatures that may characterize the inner surface of the ornament.

SUMMARY OF THE INVENTION

The present invention overcomes the above discussed shortcomings by providing a pierced earring assembly that comprises a metallic post or wire that may be effectively secured to the inner surface of an ornament no matter what the latter's shape or configuration may be, by conventional soldering means or the like, the free end of said metallic post or wire extending into and being secured within a plastic post, whereby in effect a composite metallic/plastic post is provided in which the benefits of metallic securement to the ornament are achieved, while at the same time the wearer's lobe makes contact only with the plastic portion of the post. Since after assembly the metallic/plastic composite post is a permanent assembly, the user is not required to manipulate a separate plastic part as in the above discussed IVEY patent. And since the securement of the composite metallic/plastic post to the earring ornament is a metal-to-metal connection, conventional soldering techniques may be effectively used, thus overcoming the shortcomings of the above discussed CUVAR patent.

It is therefore an object of this invention to provide a pierced earring having a composite metallic/plastic post construction.

It is a further object to provide a pierced earring wherein the portion of the composite post that is contacted by the wearer's lobe is a nontoxic plastic.

Still another object is the provision of a pierced earring having a composite metallic/plastic post wherein the portion of the post that is secured to the earring ornament is metallic.

Still another object is the provision of a pierced earring having a composite metallic/plastic post that requires no manipulation or assembly by the user than the usual mounting of the earring on the wearer's ear lobe.

Another object of the above invention is the provision of a pierced earring that is easy and economically feasible to manufacture and that is effective in use.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
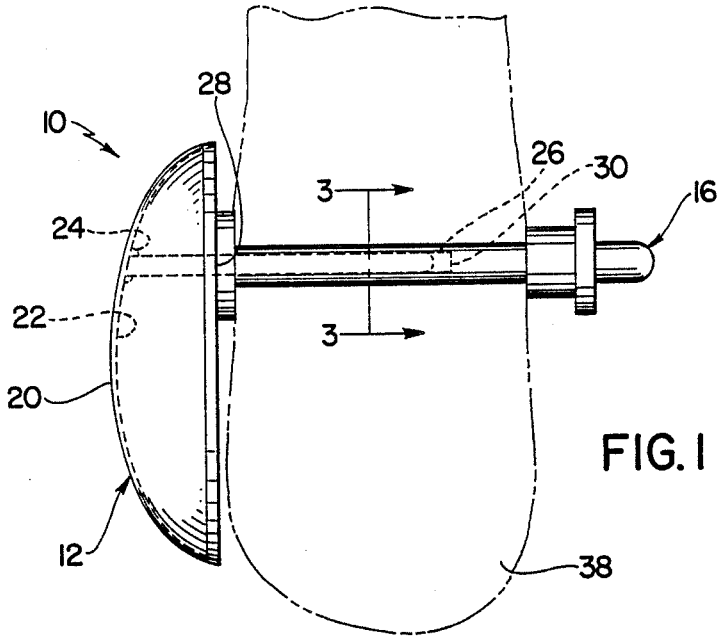
FIG. 1 is a side elevational view showing the earring assembly of the instant invention on a wearer's lobe.

Referring now to the drawings, there is shown generally at 10 a pierced earring assembly comprising an ornament 12, a metallic post or wire 14 secured thereto; a nontoxic plastic post 16 that is assembled to the metallic post 14 in a manner hereinafter to be described, and a plastic clutch member 18.

The ornament 12 may be of any desired shape or configuration, but as illustrated, it is of a button-type configuration having an outer surface 20 of convex configuration and an inner surface 22 of complementary concave configuration. The ornament 12 is preferably, although not necessarily, of metallic construction, and any desired ornamentation or engraving may be applied to the outer surface 20 thereof. The metallic post or wire 14 is secured to inner surface 22 of the ornament 12 by any desirable means, such as conventional soldering techniques, as illustrated at 24. The post or wire 14 may be of any suitable metallic material, but it specificaly does not have to be of a hypoallergenic material since, as will hereinafter become apparent, the post 14 never makes direct contact with the wearer's ear lobe.

The post 16 is constructed of any suitably nontoxic plastic material, such as nylon, and comprises an elongated bore 26 extending from end 28 and terminating intermediate the length of the post 16, as at 30. At the end 28 there is provided a circular flange 32 which is preferably an integral part of the post 16, the latter being preferably constructed by conventional injection molding techniques.

The bore 26 in post 16 is dimensioned so as to frictionally receive the metallic post 14 in press-fit relation therewith, as illustrated most clearly in FIG. 1. Once the post 14 has been inserted into post 16 so as to achieve the desired assembly between these two parts, the assembly becomes a permanent one; and in order to enhance the permanency of the connection, cement or other suitable adhesive means may be employed to secure post 14 within post 16. As will be seen most clearly in FIG. 1, when posts 14 and 16 are in their assembled relation, the end 34 of post 14 is adjacent the end 30 of bore 26, and the flange 32 is adjacent the inner surface 22 of ornament 12 but is specifically spaced therefrom.

Figure 2:
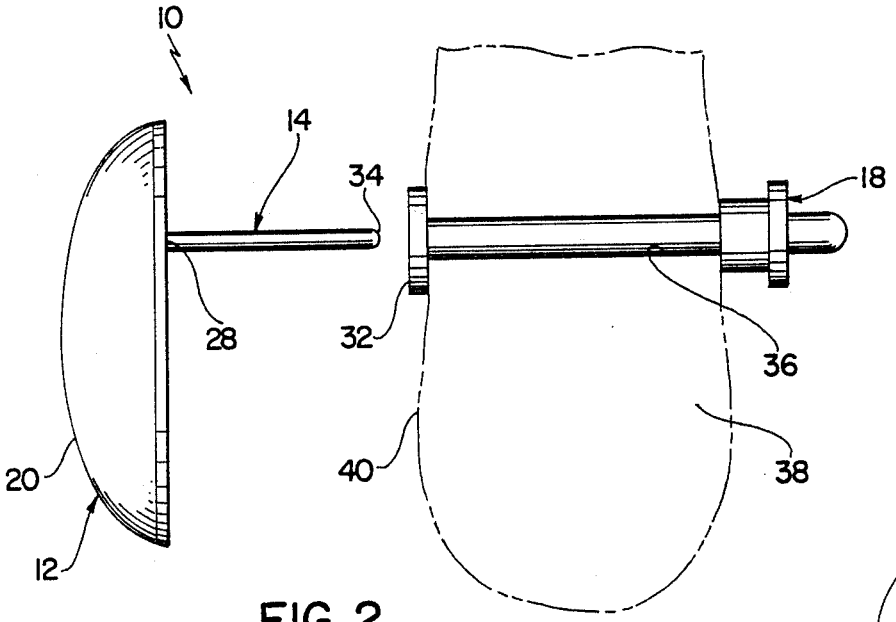
FIG. 2 is a side elevational view similar to FIG. 1 but showing the earring ornament and metallic post assembly separated from the plastic post and clutch assembly.
Figure 3:
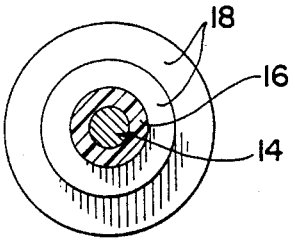
FIG. 3 is an enlarged section taken on line 3—3 of FIG. 1.

In use and operation, the pierced earring 10, with the posts 14 and 16 in their assembled relation as above described, is inserted through the pierced opening 36 in the wearer's lobe 38 until the flange 32 engages the surface 40 of the wearer's lobe, at which point the free end of post 16 will be extending through the opposite side of the wearer's lobe, as illustrated in FIGS. 1 and 2, it being understood that the length of post 16 is dimensioned so as to be comfortably longer than the thickness of a person's ear lobe. The plastic friction clutch 18, which is of conventional construction, is then slidably mounted on the free end of post 16 so as to engage the adjacent surface of the wearer's lobe and maintain the earring 10 thereon. It will be understood that clutch 18 is constructed of a resilient plastic material and has a bore extending therethrough which is of slightly lesser diameter than the outer diameter of post 16, so that when the clutch is slidably mounted on the post, it will frictionally engage same.

When the earring 10 is mounted on the wearer's lobe in the manner above described, it will be seen that only the plastic post 16 is in engagement with the wearer's ear lobe, and it will be further seen that the flange 32 functions to maintain the surface 40 of the wearer's lobe spaced from metallic post 14 and the interconnection 24 of the latter to the inner surface 22 of ornament 12. On the other hand, since the portion of the composite post that is secured to the ornament 12 is the metallic post or wire 14, conventional securement techniques, such as soldering or the like, may be employed, and hence the post 14 may be effectively secured to ornament 12 no matter what the shape or curvature of the latter may be.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pierced earring assembly comprising an ornamental member having outer and inner sides, a first elongated cylindrical post secured to and extending inwardly from said inner ornament side, a second post having a longitudinal bore extending from one end thereof and partway therethrough, said first post being snugly received within said bore and then fixedly secured therein with said one end of said second post being located adjacent to said inner ornament side, the length of said first post being such that a substantial portion of same extends through the lobe of a person's ear when the assembly is in its operative position.

2. The assembly of claim 1 further characterized in that said ornamental member and said first post are of metallic material.

3. The assembly of claim 2 further characterized in that said second post is of a hypoallergenic material.

4. In the assembly of claim 3, said hypoallergenic material being plastic.

5. In the assembly of claim 4, said first post extending into said bore for substantially the entire length of the latter.

6. In the assembly of claim 5, said first post being approximately one half the length of said second post.

7. In the assembly of claim 3, said second post being secured to said first post by cementing.

8. In the assembly of claim 1, said one end of said second post having a marginal, outwardly extending flange.

9. In the assembly of claim 8, said flange being adjacent to but in spaced relation to said inner ornament side.

10. In the assembly of claim 1, said inner ornament side having a curved configuration.

* * * * *